US006412688B1

(12) United States Patent
Tucker et al.

(10) Patent No.: US 6,412,688 B1
(45) Date of Patent: Jul. 2, 2002

(54) SECURE PARCEL RECEPTACLE, LOCK ASSEMBLY THEREFORE AND ASSOCIATED METHOD

(75) Inventors: Clifton A. Tucker, Laurel; Eric Holder, Hattiesburg; Derrick Dry, Laurel; Larry D. Robinson, Taylorsville, all of MS (US)

(73) Assignee: Solar Group, Inc., Taylorsville, MS (US)

( * ) Notice: Subject to any disclaimer, the term of this patent is extended or adjusted under 35 U.S.C. 154(b) by 0 days.

(21) Appl. No.: 09/824,138

(22) Filed: Apr. 2, 2001

Related U.S. Application Data

(60) Provisional application No. 60/227,643, filed on Aug. 24, 2000.

(51) Int. Cl.[7] ..... B65G 11/04

(52) U.S. Cl. ..... 232/45; 232/17; 292/DIG. 54; 70/161; 70/80

(58) Field of Search ..... 232/45, 44, 17; 292/DIG. 54, DIG. 65, 344; 70/161, 80

(56) References Cited

U.S. PATENT DOCUMENTS

| | | | | |
|---|---|---|---|---|
| 613,560 A | | 11/1898 | Crisp | |
| 975,455 A | | 11/1910 | Prevost | |
| 1,053,942 A | | 2/1913 | Conner et al. | |
| 1,219,360 A | | 3/1917 | Storms | |
| 1,235,123 A | | 7/1917 | Donley | |
| 1,448,066 A | | 3/1923 | Heigh et al. | |
| 3,802,619 A | * | 4/1974 | Vanderveer | 232/17 |
| 4,447,005 A | | 5/1984 | Kelly et al. | |
| 4,520,350 A | | 5/1985 | Huang | |
| 4,794,377 A | | 12/1988 | Benages | |
| 4,868,543 A | | 9/1989 | Binkley | |
| 4,872,210 A | | 10/1989 | Benages | |
| 4,999,612 A | | 3/1991 | Cherveny | |
| 5,023,595 A | | 6/1991 | Bennett | |
| 5,036,310 A | | 7/1991 | Russell | |
| 5,247,282 A | | 9/1993 | Marshall | |

(List continued on next page.)

FOREIGN PATENT DOCUMENTS

| | | |
|---|---|---|
| JP | 1204618 | 8/1989 |
| JP | 4147375 | 5/1992 |
| JP | 4267789 | 9/1992 |
| JP | 5000117 | 1/1993 |
| JP | 5147694 | 6/1993 |
| JP | 5201489 | 8/1993 |
| JP | 9173204 | 7/1997 |

*Primary Examiner*—J. J. Swann
*Assistant Examiner*—William L. Miller
(74) *Attorney, Agent, or Firm*—David C. Jenkins; Eckert Seamans Cherin & Mellot, LLC

(57) ABSTRACT

A parcel receptacle having a housing and a door member coupled to the housing, the door member structured to move between an open position and a closed position, and a lock assembly. The lock assembly includes a cam lock, a lock set assembly and a lock catch assembly. The cam lock having a latch member structured to move between a locked position and an unlocked position. The lock set assembly having a first position and a second position. The lock catch assembly having a catch member. The cam lock is coupled to the parcel receptacle door. The lock set is coupled to the parcel receptacle door adjacent to the cam lock. The catch member coupled to the housing so that the catch member is positioned to engage either the cam lock latch member or the lock set assembly when the door member is moved into the closed position. When the lock set assembly is in the first position and the door member is moved into the closed position the lock set assembly engages the catch member, and when the lock set assembly is in the second position and the door is moved into the closed position the cam lock latch member engages the catch member.

17 Claims, 7 Drawing Sheets

U.S. PATENT DOCUMENTS 5,407,126 A 4/1995 Coultas et al.
5,440,294 A 8/1995 Mercier et al.
5,444,444 A 8/1995 Ross
5,476,220 A 12/1995 Cohoon
5,586,718 A 12/1996 Speece
5,627,517 A 5/1997 Theimer et al.
5,648,770 A 7/1997 Ross
5,692,674 A 12/1997 Wicker
5,712,789 A 1/1998 Radican
5,774,053 A 6/1998 Porter
5,786,748 A 7/1998 Nikolic et al.
5,802,892 A * 9/1998 Cohn et al. ..... 70/84
5,818,336 A 10/1998 Varga et al.
5,861,805 A 1/1999 Reeves
6,028,517 A 2/2000 Sansone et al.
6,046,675 A 4/2000 Hanna
6,047,264 A 4/2000 Fisher et al.
6,064,990 A 5/2000 Goldsmith
6,070,793 A 6/2000 Reichl et al.
6,085,170 A 7/2000 Tsukuda
6,318,628 B1 * 11/2001 Pangburn ..... 232/17

* cited by examiner

SECURE PARCEL RECEPTACLE, LOCK ASSEMBLY THEREFORE AND ASSOCIATED METHOD

CROSS REFERENCE TO RELATED APPLICATIONS

This Application claims the benefit of U.S. Provisional Application Ser. No. 60/227,643, filed Aug. 24, 2000.

BACKGROUND OF THE INVENTION

1. Field of the Invention

This invention relates to a receptacle for receiving a parcel and, more specifically, to a receptacle for receiving a parcel that may be opened and closed one time, by a delivery person for example, and thereafter remains locked until opened with a key. The invention may also include an identification device, such as a bar code, that may be utilized in an electronic delivery notification system.

2. Description of the Prior Art

A common mailbox or parcel receptacle includes a housing having a hinged door. Such a parcel receptacle is simple to use; a delivery person needs only to open the door, deposit the parcel and close the door. The disadvantage to such a parcel receptacle is that persons other than the delivery person and the parcel receptacle owner can gain access to the parcel receptacle as well. Because of the opportunity for theft, many parcels will only be delivered upon the recipient signing a receipt. This arrangement is inconvenient as the recipient must wait for the delivery person. Thus, there is a need for a parcel receptacle that may be locked but which a delivery person can still access.

One solution is to provide each parcel receptacle with a lock and the delivery person with a master key. The disadvantage to this system is that having to unlock every parcel receptacle would significantly reduce the speed of the delivery person. Locations such as apartment buildings diminish the inconvenience of this system partially by providing a panel of mailboxes that can be opened with one key. However, with either individual mailboxes or with a panel of mailboxes, a thief would only have to duplicate the master key to gain access to every parcel receptacle.

Accordingly, parcel receptacles have been developed that allow a delivery person to access the parcel receptacle one time. Such a parcel receptacle includes a door locking device which includes a pre-set condition and a set condition. In the pre-set condition the locking device is not engaged, but is set to engage upon the occurrence of an event. Typically the event is the opening and closing of the parcel receptacle door. The act of opening the parcel receptacle will shift the locking device into the set position so that, upon closing the door, the locking device will engage.

In operation, the owner of the parcel receptacle will pre-set the locking device. As shown in U.S. Pat. Nos. 5,407,126 and 5,476,220, the pre-set condition requires that the door to the housing be ajar. This is a disadvantage as an open door allows undesirable elements of the environment, e.g. the rain and insects, into the housing. Additionally, while placing the parcel receptacle in the pre-set condition, the user must be sure not to close the door entirely. Another disadvantage is that the door may be accidentally closed, by someone, such as a kind neighbor who thinks the door was mistakenly left ajar, or intentionally closed by a mischievous child.

A second type of secure parcel receptacle is shown in U.S. Pat. No. 5,586,718. The door to this parcel receptacle may be fully closed. As such, there is no indication as to whether the lock is in the set or pre-set condition. Delivery people may injure themselves or damage the parcel receptacle when trying to open a locked parcel receptacle. Additionally, the lock set mechanism utilizes a spring which may degrade over time.

There is, therefore, a need for a secure parcel receptacle that can be maintained in a closed position and still be structured to open one time.

There is a further need for a secure parcel receptacle that gives a visual indication as to whether the lock device is engaged.

There is a further need for a secure parcel receptacle that does not utilize operating parts which degrade.

SUMMARY OF THE INVENTION

These needs, and others, are satisfied by the present invention which provides a secure parcel receptacle having a lock assembly that is structured to open once to allow a parcel to be placed within the receptacle, and thereafter lock the parcel receptacle in a closed position. The parcel receptacle includes a housing with a door member and a lock assembly. The door moves between a first, closed position and a second, open position. The lock assembly includes a cam lock, a lock set assembly, and a lock catch assembly. The cam lock includes a set of tumblers structured to cooperate with a key. The key can rotate the cam lock between a locked position and an unlocked position. The lock assembly further includes a latch member that rotates with the cam lock. The lock catch assembly includes a catch member structured to engage the latch member.

The lock set assembly is structured to move between a first position and a second position. More specifically, the lock set assembly includes a generally L-shaped member that may be selectively pivoted between a first position and a second position. In the first position, the L-shaped member prevents the latch member from engaging the catch member. In the second position, the L-shaped member does not prevent the latch member from engaging the catch member. The L-shaped member is structured to move by the force of gravity between the first position and the second position as the door member moved from the first, closed position to the second, open position. In order for the L-shaped member to be placed in the first position, the L-shaped member must be held in the first position while the door is being closed.

In operation, beginning with the door member in the closed position, the cam lock in the locked position and the L-shaped member in the second position, the user places a key in the cam lock and turns the key to disengage the cam lock latch member from the lock catch assembly catch member. The user then opens the door to gain access to the interior of the housing. If a parcel is within the housing it may be removed. The user then pivots the L-shaped member into the first position. When the L-shaped member is in the first position, a portion of the L-shaped member is disposed adjacent to the cam lock latch member. As the door is closed, the L-shaped member engages the lock catch assembly catch member. The user then turns the key so that the cam lock latch member is in the locked position. At this time the door may be opened without using a key.

When a delivery person opens the door gravity, inertia, or a combination thereof, will cause the L-shaped member to pivot into the second position. The delivery person then places a parcel in the housing. When the delivery person closes the door, the cam lock latch member engages the lock catch assembly catch member, thereby locking the parcel receptacle.

The L-shaped member has a pivot pin at the vertex. The pivot pin is coupled to the housing. The L-shaped member includes a first leg and a second leg. The legs may be color coded so that a first color is visible from outside the door when the L-shaped member is in the first position and a second color is visible from outside the door when the L-shaped member is in the second position.

The invention provides a parcel receptacle having a housing and a door member coupled to the housing, the door member structured to move between an open position and a closed position, a lock assembly which includes, a cam lock having a latch member structured to move between a locked position and an unlocked position, a lock set assembly having a first position and a second position, a lock catch assembly having a catch member, the cam lock coupled to the parcel receptacle door, the lock set coupled to the parcel receptacle door adjacent to the cam lock, the catch member coupled to the housing so that the catch member is positioned to engage either the cam lock latch member or the lock set assembly when the door member is moved into the closed position and wherein when the lock set assembly is in the first position and the door member is moved into the closed position said lock set assembly engages the catch member, and when the lock set assembly is in the second position and the door is moved into the closed position the cam lock latch member engages the catch member.

It is an object of this invention to provide a parcel receptacle that may be configured to be opened one time and, upon closing the parcel receptacle, thereafter be locked.

It is a further object of this invention to provide a lock set having a first position that prevents a parcel receptacle lock assembly from engaging and a second position that allows a parcel receptacle lock assembly to engage.

It is a further object of this invention to provide a lock set that is moved by gravity and/or inertia from the first position to the second position as the parcel receptacle door is opened.

It is a further object of this invention to provide a lock set that gives a visual indication as to which position the lock set is in.

It is a further object of this invention to provide a method of using a parcel receptacle having a lock assembly and a lock set with a first position that prevents the lock assembly from being engaged and, while the parcel receptacle is being opened, moves to a second position which allows a lock assembly to be engaged.

DESCRIPTION OF THE DRAWINGS

These and other advantages of the present invention will become readily apparent upon consideration of the following detailed description and attached drawings, wherein.

DETAILED DESCRIPTION OF A PREFERRED EMBODIMENT

As used herein, "parcel" means any package, box, or envelope, made from any material, that is delivered from one location to another.

Figure 1A:
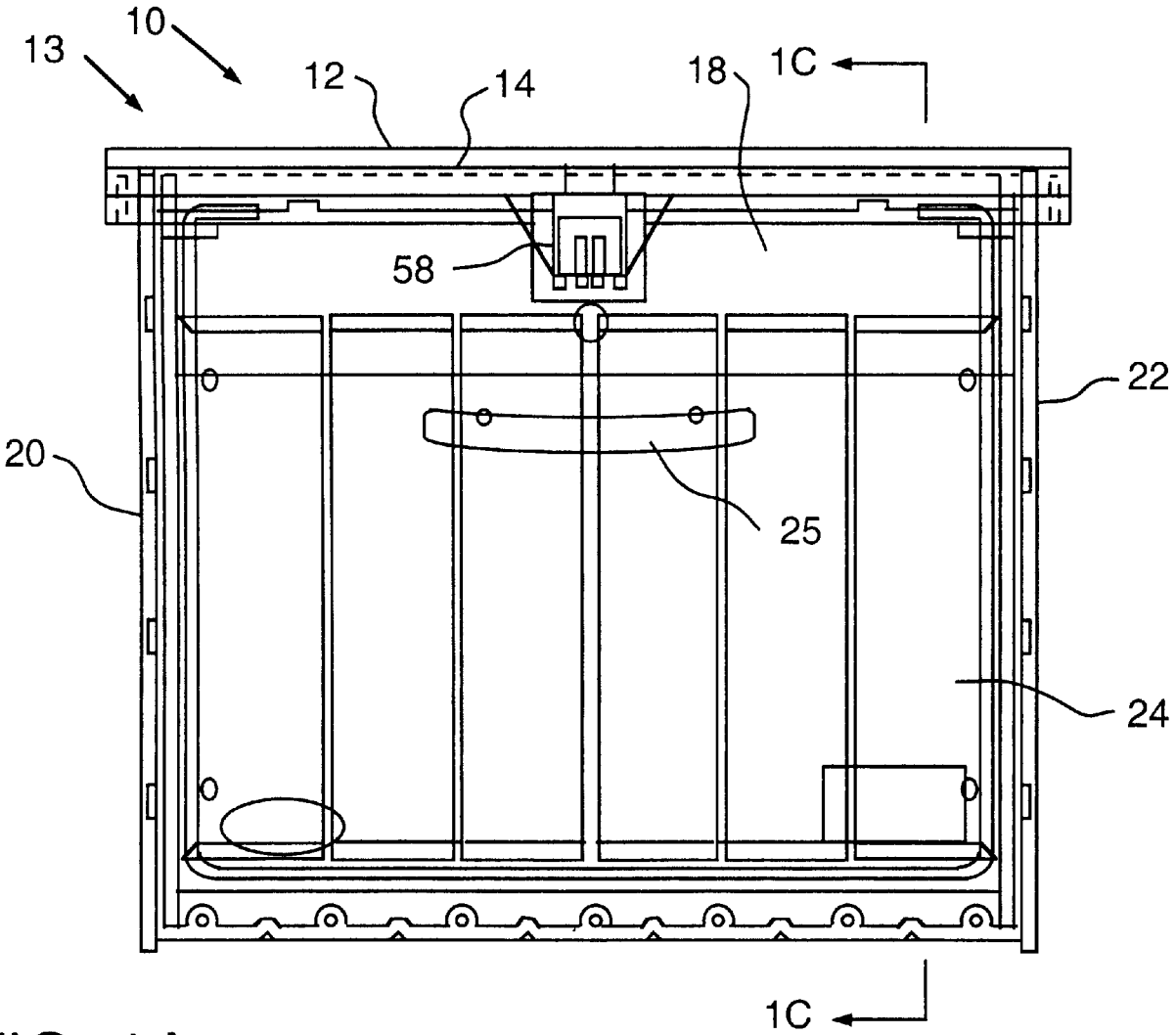
FIG. 1A is a front elevational view of the parcel receptacle.
Figure 1C:
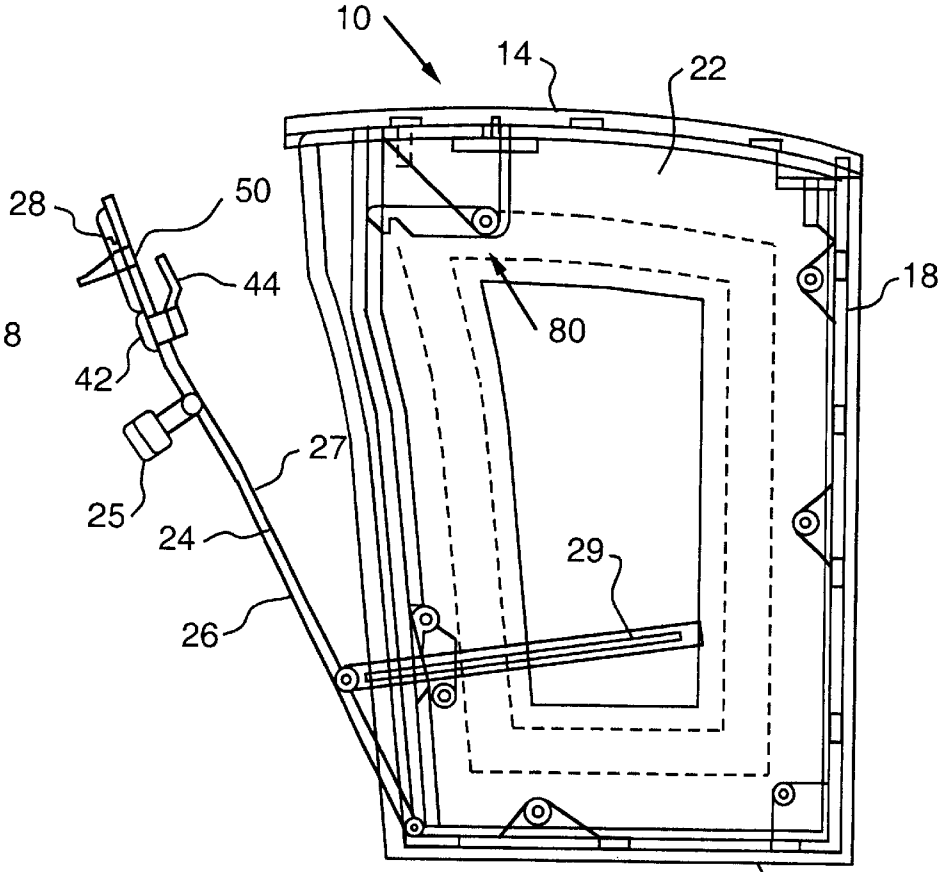
FIG. 1C is a cross-sectional side view of the parcel receptacle taken along line C—C from FIG. 1A.
Figure 1B:
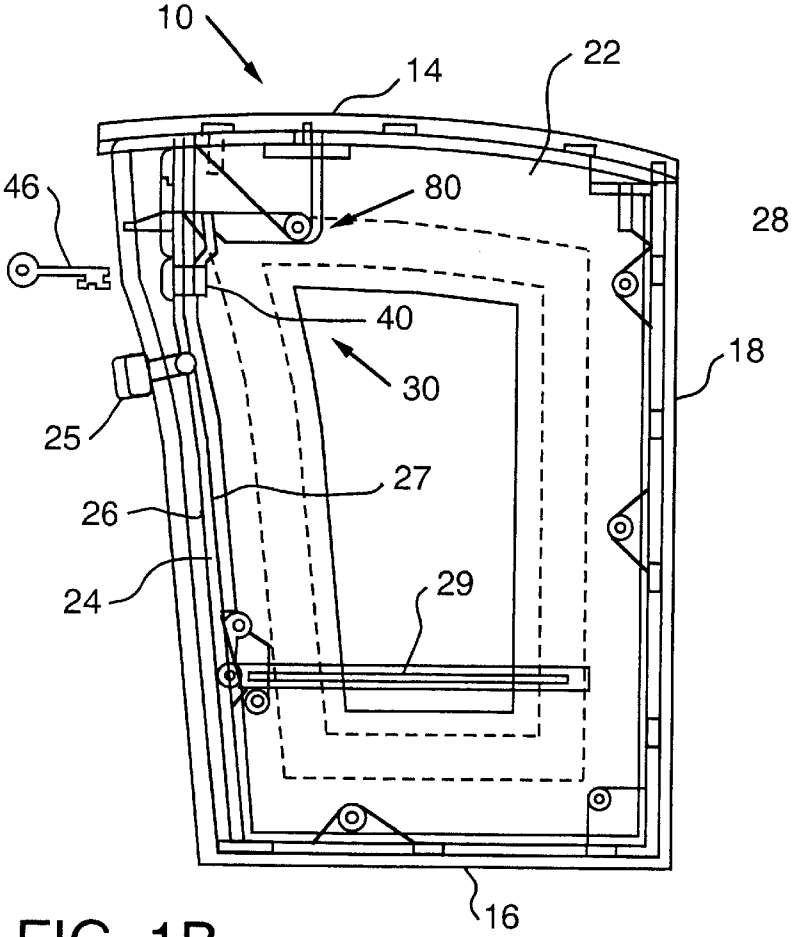
FIG. 1B is a cross-sectional side view of the parcel receptacle.

As shown in FIGS. 1A–1C, a parcel receptacle 10 includes a housing 12 having a plurality of stationary members 13 and a door 24. The stationary members 13 include a top member 14, a bottom member, 16, a back member 18, and two side members 20, 22. A door member 24 is pivotally coupled to the stationary members 13. The door member 24 is structured to pivot between a first, closed position, shown in FIG. 1B, and a second, open position, shown in FIG. 1C. When the door member 24 is in the first position, the housing 12 forms an enclosure. The housing may be made of any material that is sufficiently rigid to prevent the parcel receptacle 10 from deforming. Such materials include, but are not limited to, metal, plastics, laminates, and composites.

The door member 24 includes a handle member 25, a first, outer side 26, and a second, inner side 27. A lock set assembly opening 28 extends between the first side 26 and the second side 27. The door member 24 may be attached to one or more guide members 29. The guide member 29 is further attached to a housing side member 22. The guide member 29 provides support for the door member 24.

The parcel receptacle 10 also includes a lock assembly 30. The lock assembly 30 includes a cam lock assembly 40, a lock set assembly 50 and a lock catch assembly 80. The cam lock assembly 30 and the lock set assembly 50 are coupled to the door member 24. The lock catch assembly 80 is coupled to one of the stationary members 13, preferably to the medial portion of top member 14. The cam lock assembly 40 includes a cam lock 42, as is well known in the prior art, which is coupled to a latch member 44. The cam lock 42 is structured to rotate in cooperation with a key 46. Rotation of the cam lock 42 causes the latch member 44 to rotate between a locked position and an unlocked position.

Figure 2:
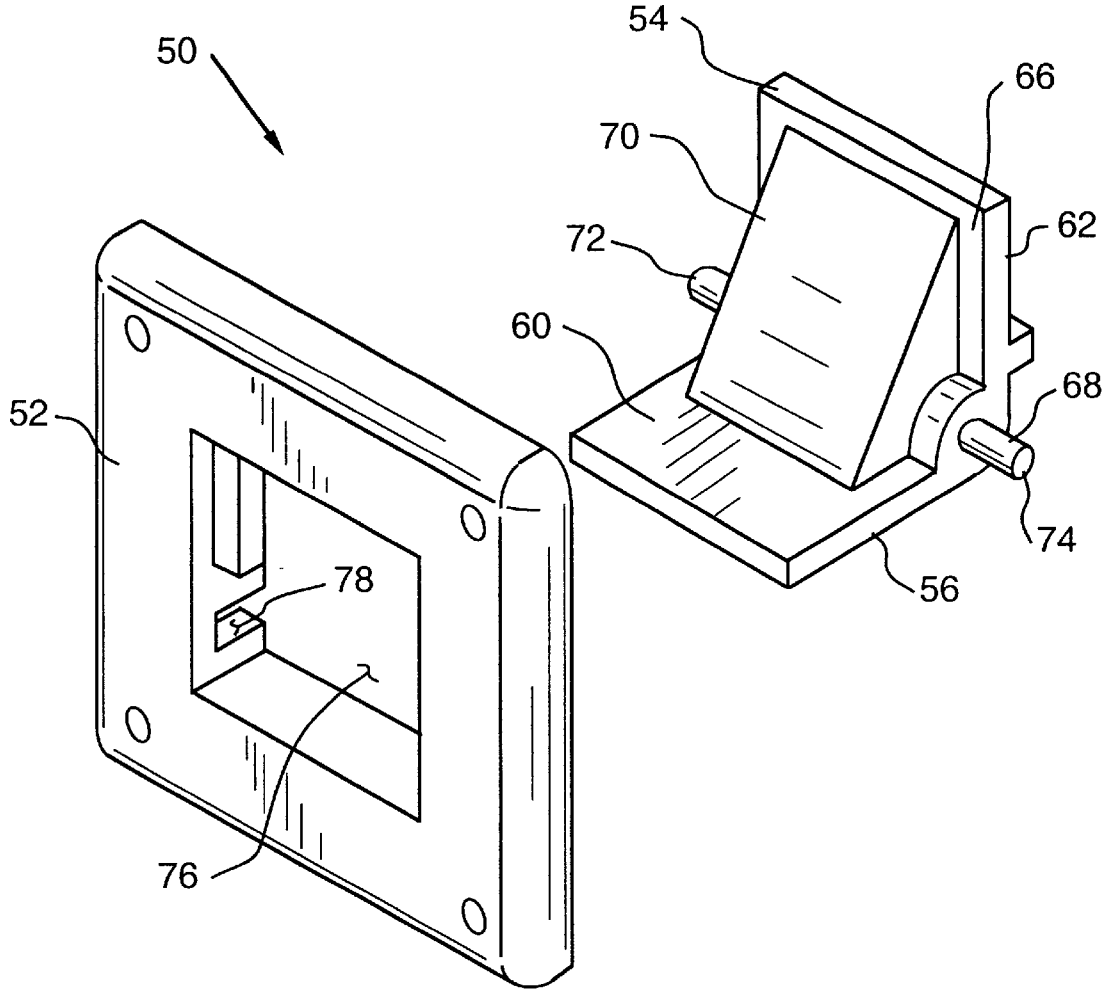
FIG. 2 is an exploded detail view of the lock set assembly.

As shown in FIG. 2, the lock set assembly 50 includes a mounting plate 52 and a generally L-shaped member 54. The L-shaped member 54 includes a first leg 56, having a first side 58 (FIG. 1) and a second side 60, and a second leg 62 having a first side 64 (FIG. 4) and a second side 66. The first leg 56 and the second leg 62 are coupled together at a generally right angle at vertex 68. A wedge member 70 extends between first leg second side 60 and second leg second side 66. Pivot pins 72, 74 extend laterally from vertex 68. Mounting plate 52 includes an opening 76 which is sized to allow first leg 56 to pass therethrough. Mounting plate 52 also includes pivot pin hallows 78. The pivot pin hallows 78 are structured to correspond to the size and spacing of pivot pins 72, 74.

The mounting plate 52 is attached to the door first side 26 so that the L-shaped member 54 will extend through lock set opening 28. The L-shaped member 54 is pivotally attached to the mounting plate 52 and pivots between a first position wherein the first leg is generally parallel to door member 24 and a second position wherein the second leg member 62 is generally parallel to door member 24. When viewed from a location in front of the parcel receptacle 10 and when the L-shaped member 54 is in the first position, the first leg first side 58 is visible. When viewed from a location in front of the parcel receptacle 10 and when the L-shaped member 54 is in the second position, the second leg second side 66 is visible. First leg first side 58 is of first color which is, preferably, the color as the door member 24 or a dark color. Second leg member second side 66 is a second color which is, preferably, a bright color. Thus, when the L-shaped member 54 is in the first position, the dark first leg first side 58 is visible. When the L-shaped member 54 is in the second position, the bright second leg second side 66 is visible.

Figure 3:
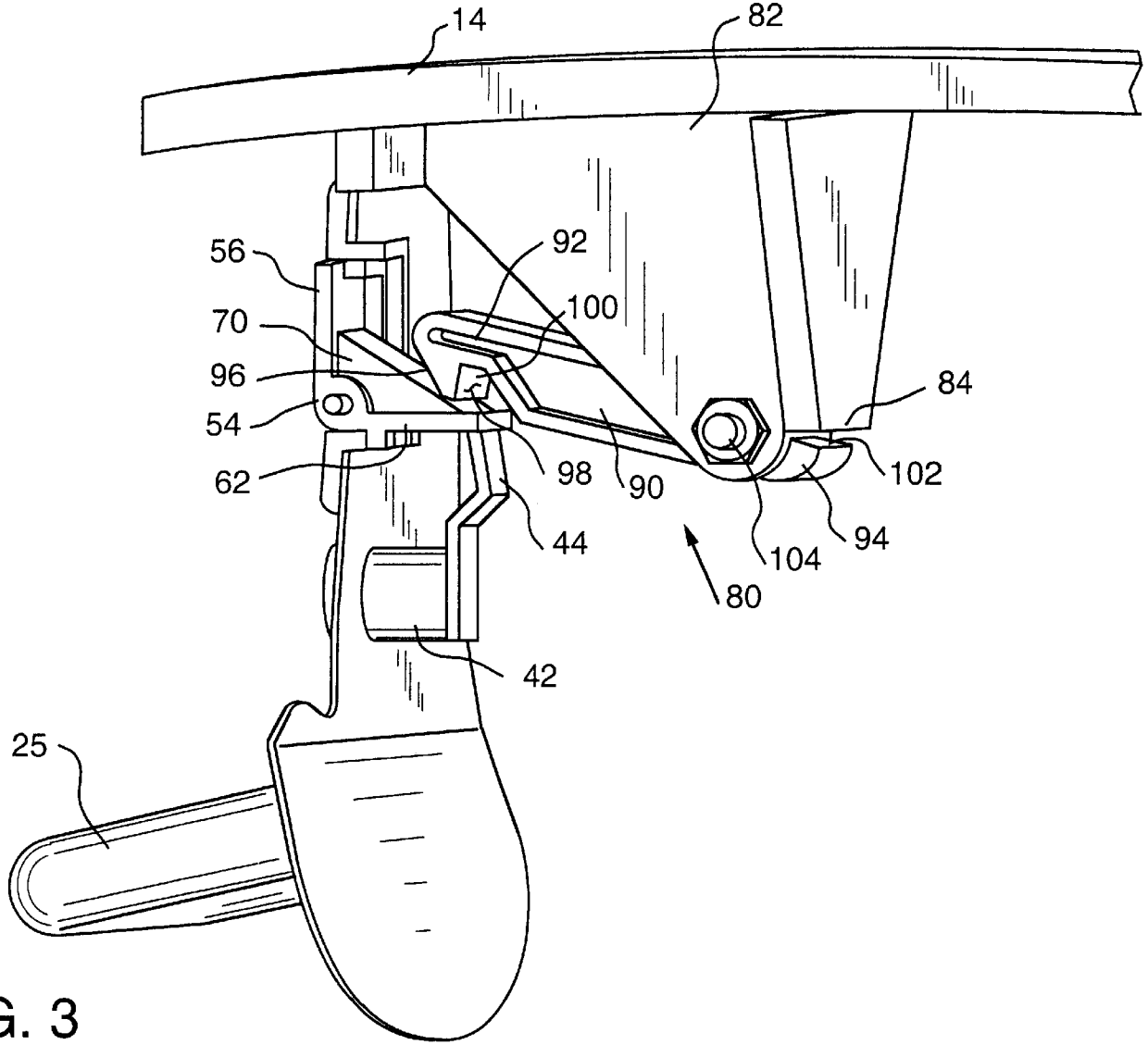
FIG. 3 is an isometric view of the lock assembly with the lock set assembly in the first position.

As shown in FIG. 3, the catch assembly 80 includes a mounting plate 82 and an elongated catch member 90. The catch member 90 is pivotally coupled to the mounting plate 82. The mounting plate is coupled to a stationary housing member 13, preferably top member 14. The mounting plate 82 includes a pivot stop 84. Mounting plate 82 also includes a pin opening (not shown). The catch member 90 includes a first end 92 and a second end 94. The catch member first end 92 has an angled outer edge 96 and a notch 98. The notch 98 includes a flat surface 100 that extends in a direction generally perpendicular to the longitudinal axis of the catch member 90 and adjacent to outer edge 96. The catch member second end 94 includes a stop tab 102. The stop tab 102 is a surface that extends in a plane generally parallel with the longitudinal axis of the catch member 90. The catch member second end 94 also includes a pin opening (not shown). A pin 104 extends through the mounting plate 82 pin opening and the catch member 90 opening, thereby pivotally coupling the catch member 90 to the mounting plate 82. The catch member 90 is maintained in a generally horizontal orientation by gravity and the interaction of pivot stop 84 and stop tab 102.

Figure 4:
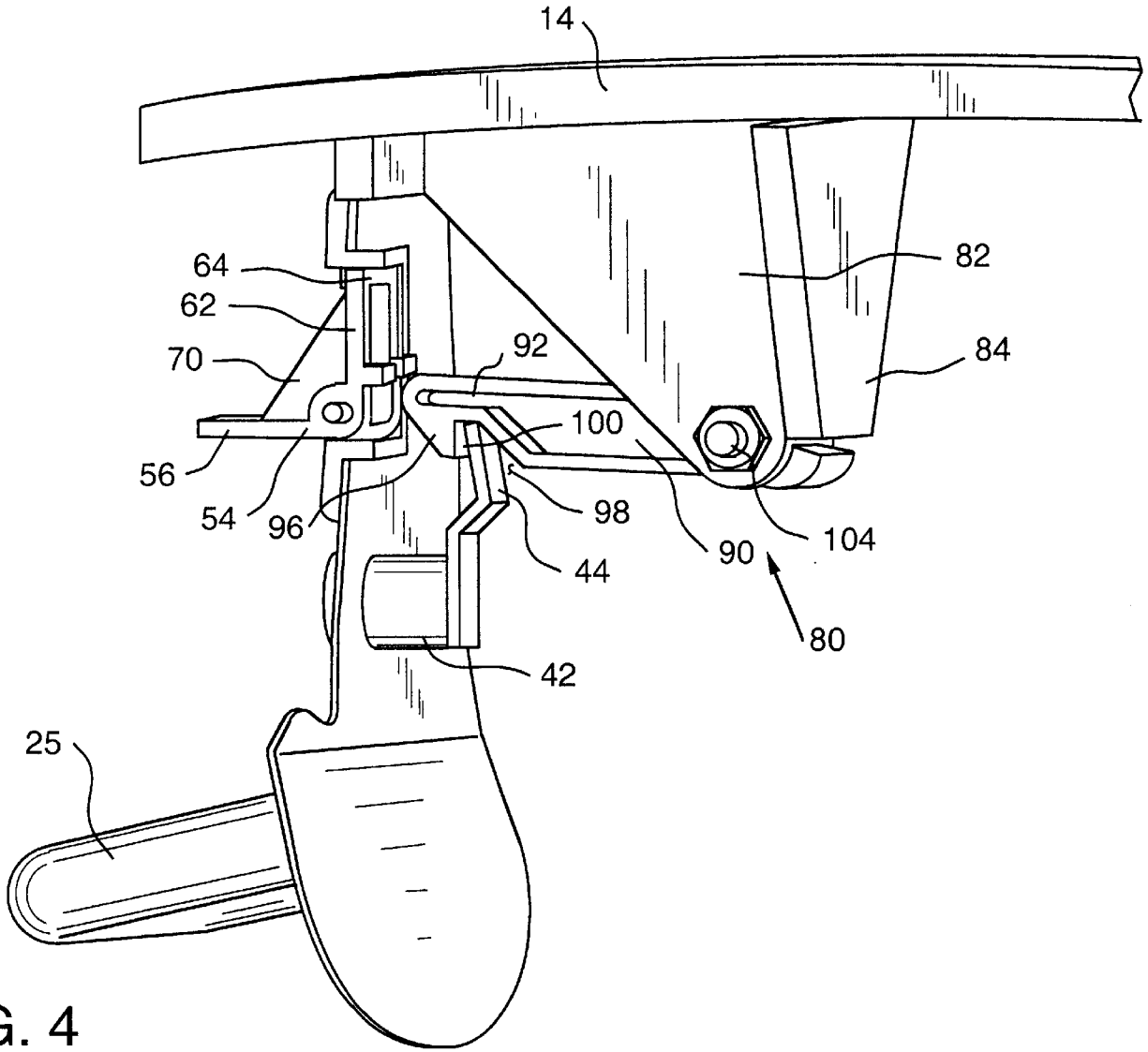
FIG. 4 is an isometric view of the lock assembly with the lock set assembly in the second position.

As shown in FIG. 4, when parcel receptacle 10 is assembled and the door 24 is in the first position, the cam lock assembly 40 is disposed adjacent to the lock catch assembly 80. The position of the cam lock assembly 40 relative to the lock catch assembly 80 is such that, when the lock catch assembly L-shaped member is in the second position ,the cam lock assembly is in the locked position and the door 24 is in the closed position, the latch member 44 is disposed within notch 98. If a user attempts to open door 24, the latch member 44 will engage flat surface 100, thereby preventing the door 24 from opening. To open door 24, a user must insert key 46 into the cam lock 42 and rotate the latch member 44 out of notch 98.

The lock set assembly 50 acts to prevent the latch member 44 from engaging the catch member 90 one time after the lock set assembly 50 is set. As shown in FIG. 3, when the lock set assembly L-shaped member 54 is in the first position, the cam lock assembly is in the locked position and the door 24 is in the closed position, the second leg 62 is disposed between the latch member 44 and the catch member 90. That is, the second leg 62 acts to prevent the latch member 44 from engaging the catch member 90. Thus, even if the cam lock 42 is in the locked position, the door 24 may be opened as the latch member 44 is not engaging the catch member 90.

In operation, a user must set the cam lock 42 in the locked position, the lock set assembly 50 in the first position, and place the door member 24 in the closed position. In this configuration, the door may be opened without unlocking cam lock 42. When a delivery person opens the door member 24 to deposit a parcel, gravity and/or inertia will move the lock set assembly into the second position. That is, gravity and/or inertia will cause the L-shaped member 54 to pivot on pivot pins 72, 74 so that the first leg 56 moves from an orientation relatively parallel to door member 24 to an orientation relatively perpendicular to door member 24. When the delivery person closes the door member 24, latch member 24 will contact catch member outer surface 96. As the catch member outer surface 96 is angled, the catch member 90 will pivot on about pin 104 clockwise, as shown in FIGS. 3 and 4, until latch member 44 moves into notch 98. At this time the delivery person deposits a parcel within the housing 12 and closes the door member 24. In this configuration, with the door member 24 in the closed position, the L-shaped member 54 in the second position, and the cam lock 42 in the locked position, the door member 24 may not be opened with out a key 46.

Figure 5:
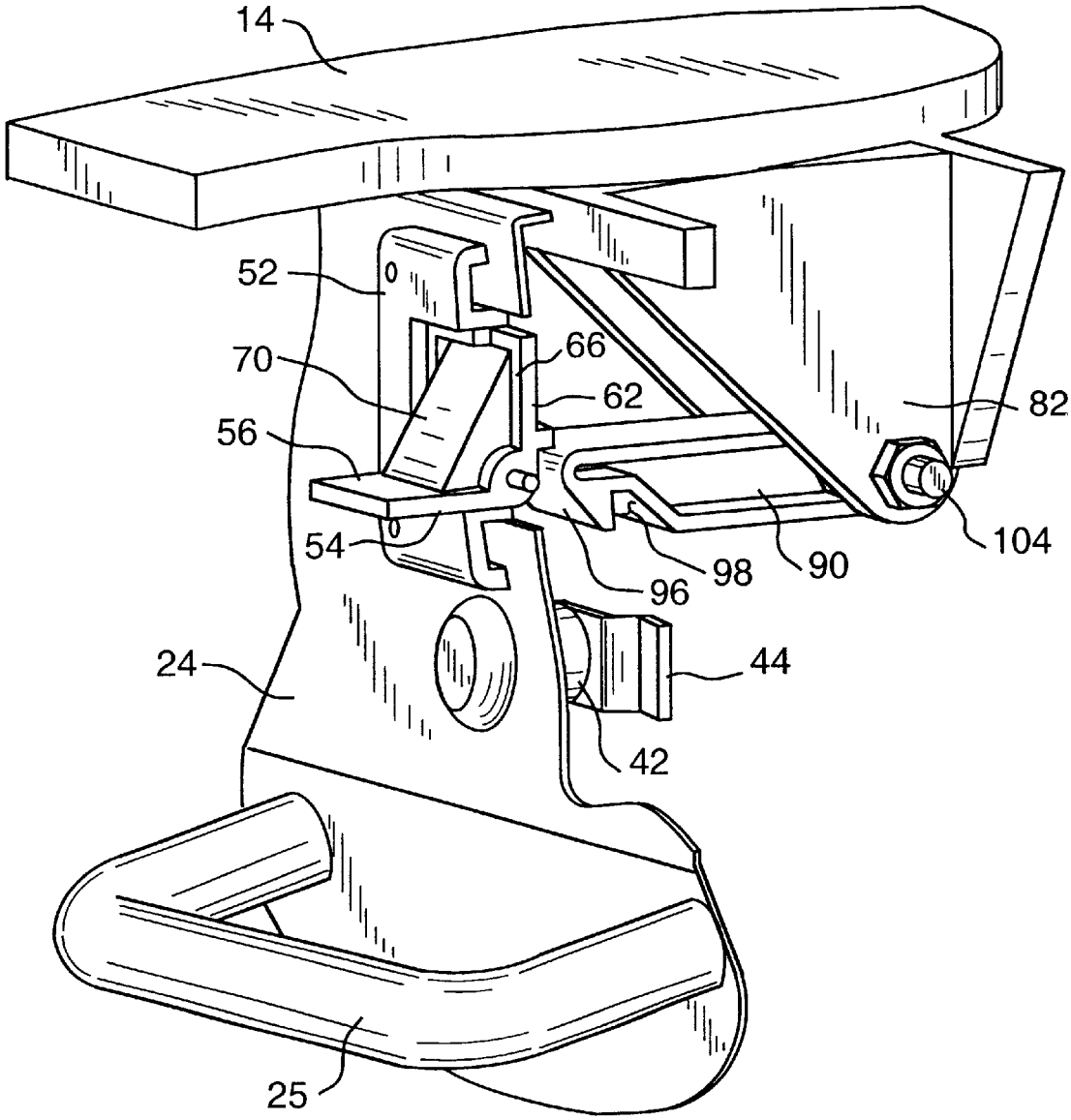
FIG. 5 is an isometric view of the lock assembly with the cam lock in the unlocked position.

To open the parcel receptacle 10, the user must insert the key 46 into cam lock 42 and rotate latch member 44 out of notch 98. In this configuration, with the door member 24 in the closed position, the L-shaped member 54 in the second position, and the cam lock 42 in the unlocked position, the door member 24 may be opened. The user opens door member 24 to remove the parcel from the housing 12. The user then resets the lock set assembly 80 by pivoting the L-shaped member 54 into the first position. The user then closes the door member 24. As the door member 24 is closing, second leg 62 will contact catch member outer surface 96. As the catch member outer surface 96 is angled, the catch member 90 will pivot on about pin 104 clockwise, as shown in FIGS. 3 and 4, until the catch member rests on second leg 62, or, preferably, wedge 70. The user then returns the cam lock 42 to the locked position. Thus, the parcel receptacle 10 is returned to the original configuration with lock set assembly L-shaped member 54 is in the first position, the cam lock 42 in the locked position and the door 24 is in the closed position. In this configuration, the parcel receptacle 10 may be opened without the key 46. A user may, of course, leave the cam lock 42 in the unlocked position. As shown in FIG. 5, any time the cam lock 42 is in the unlocked position, the door member 24 may be opened an unlimited number of times without a key 46.

The parcel receptacle 10 may be used as in integral part of an electronic delivery notification system. The electronic delivery notification system coordinates the delivery of parcels to parcel receptacles 10 by utilizing an identification means such as numbers or codes, such as a bar code, on each parcel receptacle 10 and on the parcel. The electronic delivery system is operated by a service provider.

Figure 6:
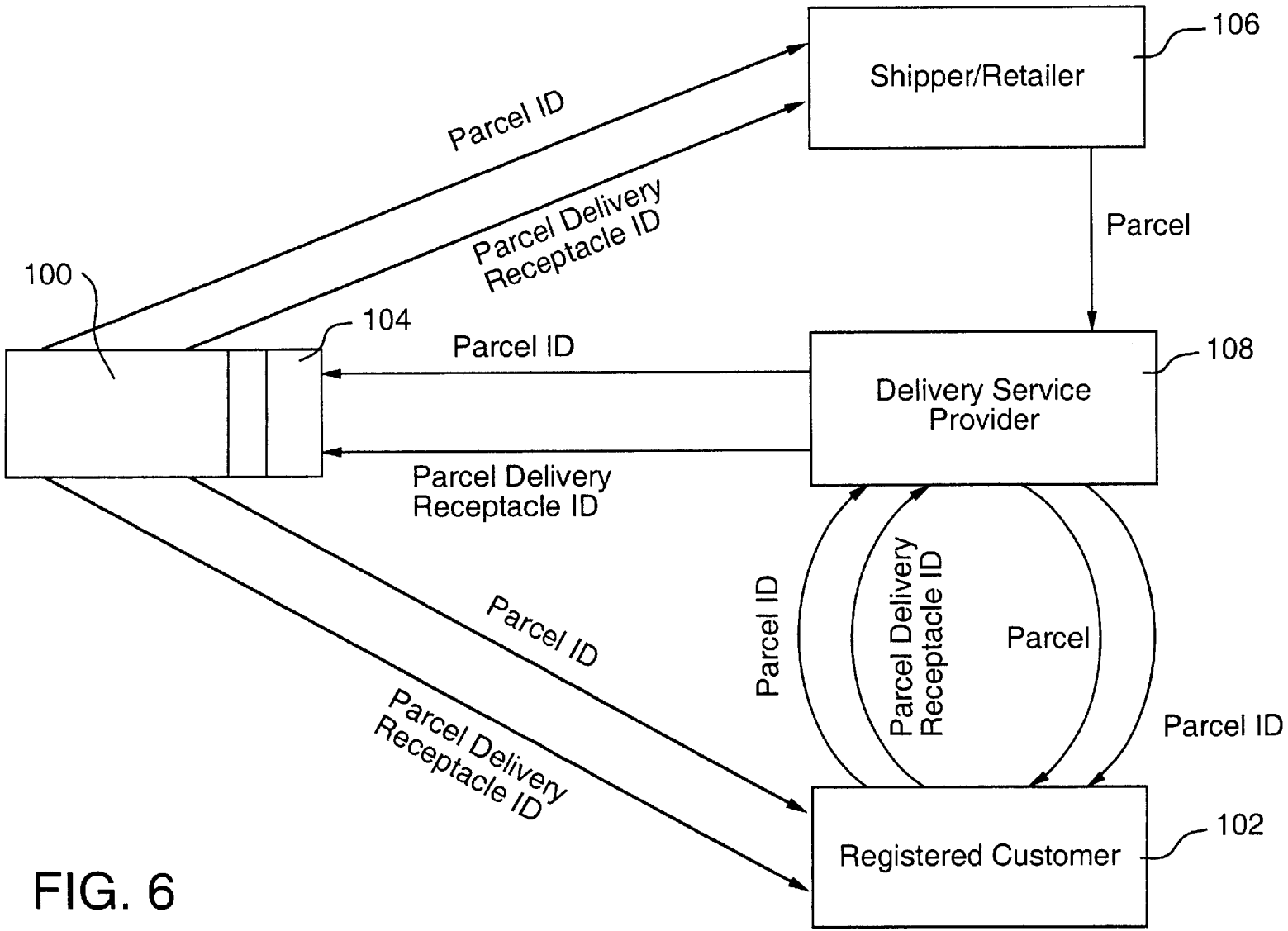
FIG. 6 is a schematic diagram of an electronic delivery notification system.

As shown schematically on FIG. 6, a service provider 100 provides parcel receptacles 10 to registered customers 102. Each parcel receptacle 10 includes an identification means 99 (FIG. 1) such as a serial number and/or bar code. The service provider maintains an electronic database 104 that includes data as to the location of each registered customer 102. The retailer and/or shipper 106 provides parcel identification means, such as a bar code labels. When a registered customer 102 orders a product from a retailer 106, the retailer 106 accesses the database to identify the customer's parcel receptacle 10 identification number. When the parcel is ready to be delivered, the retailer 106 then applies a label to the parcel, enters the parcel identification number into the database 104, and delivers the parcel to a delivery service 108. Thus, the database has a record of the parcel identification number and the intended destination. The delivery service 108 utilizes a portable tracking device, such as a bar code scanner, that can communicate with the electronic database 104. When the delivery service delivers the parcel to the parcel receptacle 10, the delivery service can verify that it is at the proper location by accessing the database and comparing the parcel receptacle 10 identification with the intended destination. Once the parcel is placed in the parcel receptacle 10, as described above, the delivery service enters data into the database 104 indicative of a successful delivery.

The database will then notify the customer 102 of a successful delivery by a means such as a telephone message or e-mail. At any time, the customer 102 can access the database 104 through via an electronic means, such as the Internet, to check on the status of the parcel.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A parcel receptacle comprising:

a housing;

a door member pivotally coupled to said housing;

said door member structured to move between an open position and a closed position;

a lock assembly comprising:

a cam lock having a latch member structured to move between a locked position and an unlocked position;

a lock set assembly having a first position and a second position;

a lock catch assembly having a catch member;

said cam lock coupled to said parcel receptacle door;

said lock set coupled to said parcel receptacle door adjacent to said cam lock;

said catch member coupled to said housing and structured to engage either said cam lock latch member or said lock set assembly when said door member is moved into said closed position; and wherein when said lock set assembly is in said first position and said door member is moved into said closed position said lock set assembly engages said catch member, and when said lock set assembly is in said second position and said door is moved into said closed position said cam lock latch member engages said catch member.

2. The parcel receptacle of claim 1, wherein, said lock set assembly includes a generally L-shaped member structured to pivot between said first position and said second position.

3. The parcel receptacle of claim 2, wherein, said L-shaped member is structured to move into said second position by the force of gravity or inertia when said door member is moved into said open position.

4. The parcel receptacle of claim 3, wherein, said L-shaped member is structured to be biased by an external force into said first position when said door member is moved into said closed position.

5. The parcel receptacle of claim 2, wherein:

said L-shaped member has a first leg and a second leg;

said first leg having a first side and a second side;

said second leg having a first side and a second side;

said first leg first side having a first color; and said second leg second side having a second color; and wherein said lock set is structured so that said first leg first side is visible outside said door when said lock set is in said first position and said second leg second side is visible outside said door member when said lock set is in said second position.

6. The parcel receptacle of claim 5 wherein:

said L-shaped member includes a wedge member extending between said first leg second side and said second leg second side; and said wedge structured to engage said catch member when said lock set assembly is in said first position and said door member in moved into said closed position.

7. The parcel receptacle of claim 1 wherein said cam lock is structured to not engage said lock catch when said cam lock is in said unlocked position.

8. A lock assembly for a parcel receptacle having a housing and a door member coupled to said housing, said door member structured to move between an open position and a closed position, said lock assembly comprising:

a cam lock having a latch member structured to move between a locked position and an unlocked position;

a lock set assembly having a first position and a second position;

a lock catch assembly having an elongated catch member;

said cam lock coupled to said parcel receptacle door;

said lock set coupled to said parcel receptacle door adjacent to said cam lock;

said catch member coupled to said housing and structured to engage either said cam lock latch member or said lock set assembly when said door member is moved into said closed position; and wherein when said lock set assembly is in said first position and said door member is moved into said closed position said lock set assembly engages said catch member, and when said lock set assembly is in said second position and said door is moved into said closed position said cam lock latch member engages said catch member.

9. The lock assembly of claim 8, wherein, said lock set assembly includes an L-shaped member structured to pivot between said first position and said second position.

10. The lock assembly of claim 9, wherein, said L-shaped member is structured to move into said second position by the force of gravity or inertia when said door member is moved into said open position.

11. The lock assembly of claim 10, wherein, said L-shaped member is structured to be biased by an external force into said first position when said door member is moved into said closed position.

12. The lock assembly of claim 10, wherein:

said L-shaped member has a first leg and a second leg;

said first leg having a first side and a second side;

said second leg having a first side and a second side;

said first leg first side having a first color; and said second leg second side having a second color; and wherein said lock set assembly is structured so that said first leg first side is visible outside said door member when said lock set is in said first position and said second leg second side is visible outside said door member when said lock set is in said second position.

13. The lock assembly of claim 12 wherein:

said L-shaped member includes a wedge member extending between said first leg second side and said second leg second side;

said wedge structured to engage said catch member when said lock set is in said first position and said door member in moved into said closed position.

14. The lock assembly of claim 8 wherein said cam lock is structured to not engage said catch member when said cam lock is in said unlocked position.

15. A method of using a parcel receptacle having a housing, a door member pivotally coupled to said housing, said door member structured to move between an open position and a closed position, a lock assembly comprising: a cam lock having a latch member structured to move between a locked position and an unlocked position, a lock set assembly having a first position and a second position, a lock catch assembly having a catch member, said cam lock coupled to said parcel receptacle door, said lock set coupled to said parcel receptacle door adjacent to said cam lock, said catch member coupled to said housing so that said catch member is positioned to engage either said cam lock latch member or said lock set assembly when said door member is moved into said closed position, wherein when said lock set assembly is in said first position and said door member is moved into said closed position said lock set assembly engages said catch member, and when said lock set assembly is in said second position and said door is moved into said closed position said cam lock latch member engages said catch member, said method comprising the steps of:

a) placing said door member in said closed position, said lock catch assembly in said first position, and said cam lock in said locked position;

b) opening said door member;

c) allowing gravity or inertia to move said lock set assembly into said second position;

d) placing a parcel in said housing; and e) closing said door member to effect locking said lock assembly.

16. The method of claim 15 comprising the further steps of:

a) providing a key which corresponds to said cam lock;

b) unlocking said lock assembly;

c) opening said door; and d) removing said parcel from said housing.

17. The method of claim 15 comprising the further step of:

a) resetting said parcel receptacle by placing said lock catch assembly in said first position, said door member in said closed position, and said cam lock in said locked position.

* * * * *